US005842488A

United States Patent [19]

Belleau et al.

[11] Patent Number: 5,842,488

[45] Date of Patent: Dec. 1, 1998

[54] LOTION APPLICATOR APPARATUS AND METHOD

[76] Inventors: Gary P. Belleau, 8440 6th Ave. South #4, Tacoma, Wash. 98465; Luis P. Hamel, Jr., 5121 83rd Ave. West, University Place, Wash. 98467

[21] Appl. No.: 844,394

[22] Filed: Apr. 18, 1997

[51] Int. Cl.[6] ..... A45D 40/26

[52] U.S. Cl. ..... 132/320; 15/244.1; 15/244.2; 15/144.1; 15/144.3

[58] Field of Search ..... 132/320, 317, 132/315; D28/7; 15/244.1, 244.2, 210.1, 144.1, 144.3, 185

[56] References Cited

U.S. PATENT DOCUMENTS

| | | | |
|---|---|---|---|
| D. 145,286 | 7/1946 | Crane | 132/320 |
| D. 375,816 | 11/1996 | Long-Langworthy | D28/7 |
| 1,537,467 | 5/1925 | Ingle | 15/185 |
| 1,631,133 | 6/1927 | Jones | 15/244.1 |
| 2,744,278 | 5/1956 | Roth | 15/185 |
| 2,750,616 | 6/1956 | Klugmann | 15/144.1 |
| 2,875,462 | 3/1959 | Wittnebert . | |
| 3,124,828 | 3/1964 | Barber et al. . | |
| 3,336,703 | 8/1967 | Multer | 15/144.1 |
| 3,340,556 | 9/1967 | Allen . | |
| 3,491,397 | 1/1970 | Hesener . | |
| 3,568,237 | 3/1971 | Rhodes . | |
| 3,596,946 | 8/1971 | Berton . | |
| 3,704,480 | 12/1972 | Whitaker . | |
| 3,771,190 | 11/1973 | Tischler et al. . | |
| 4,078,865 | 3/1978 | Moser . | |
| 4,135,274 | 1/1979 | Freeman . | |
| 4,165,755 | 8/1979 | Cassai . | |
| 4,171,171 | 10/1979 | Jones . | |
| 4,299,005 | 11/1981 | Brown . | |
| 4,396,028 | 8/1983 | Waggoner . | |
| 4,934,011 | 6/1990 | Haug . | |
| 5,566,418 | 10/1996 | Steffen et al. | 15/244.1 |
| 5,664,281 | 9/1997 | Pelfrey | 15/210.1 |

FOREIGN PATENT DOCUMENTS

| | | | |
|---|---|---|---|
| 268261 | 10/1929 | Italy | 15/185 |

*Primary Examiner*—Todd E. Manahan
*Assistant Examiner*—Eduardo C. Robert
*Attorney, Agent, or Firm*—William G. Forster

[57] ABSTRACT

The invention is a folding lotion applicator for applying liquids, lotions, and other materials to hard-to-reach places on the user's body. The applicator includes an elongated applicator handle for griping. The applicator handle is pivotally connected to an elongated pivot arm which extends from the applicator handle and includes an opposing applicator end with a pad for applying lotions. The pivot arm can be pivoted to a plurality of pre-determined pivot angles wherein a biasing member/tightening nut is employed to urge the pivot arm against the applicator handle wherein opposing detent surfaces interengage thereby locking the pivot arm in the desired or selected pivot angle. A portion of the applicator handle is formed to define a receiving seat to receive the pivot arm when it is completely folded adjacent to the applicator handle. In this way, the lotion applicator can assume a compact arrangement suitable for situations where economy of space is desirable.

6 Claims, 4 Drawing Sheets

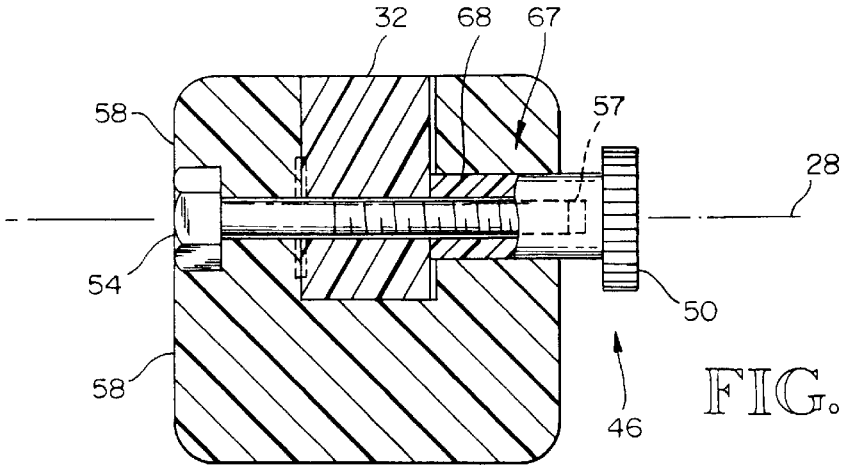
FIG. 3
FIG. 4
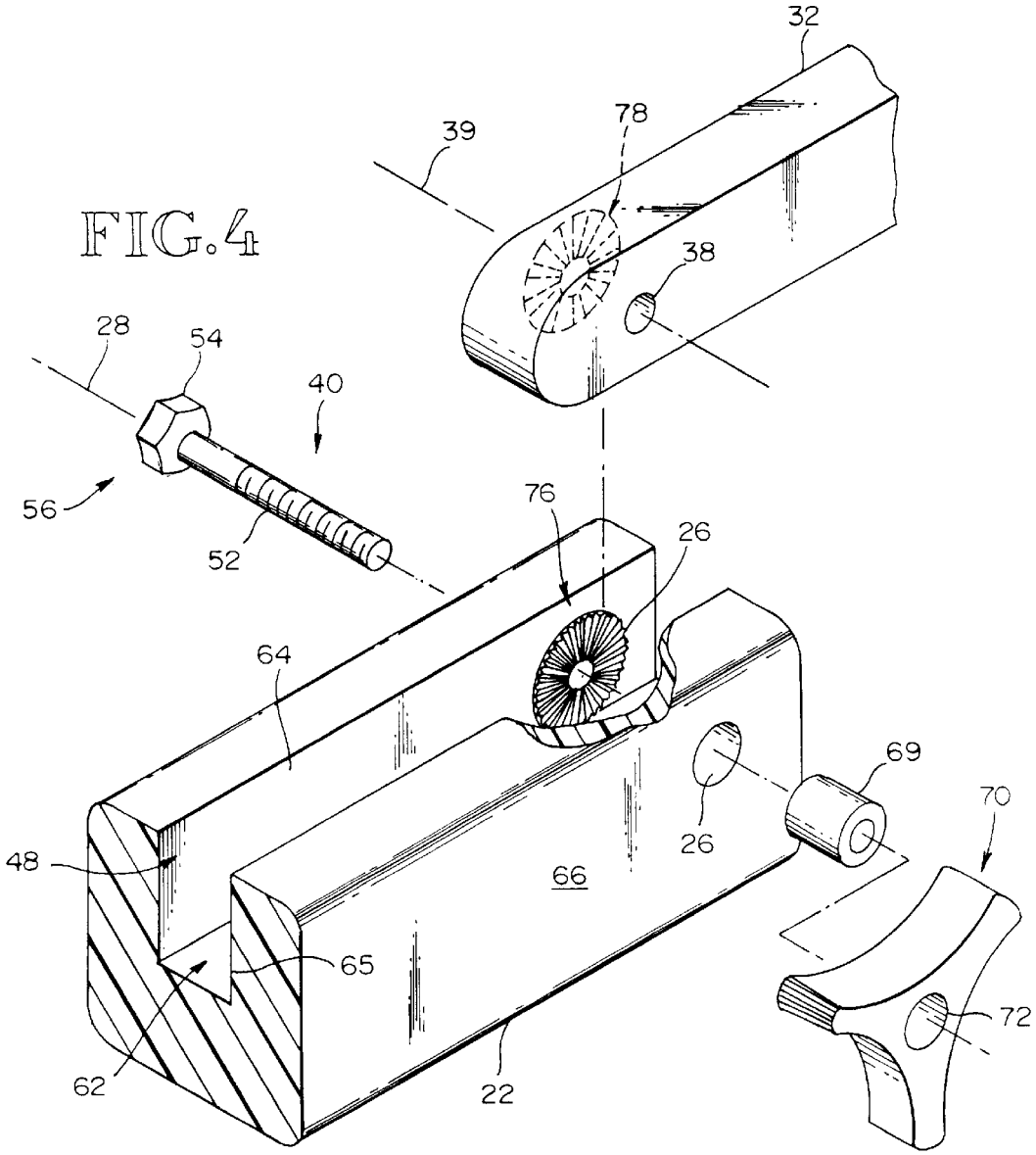

LOTION APPLICATOR APPARATUS AND METHOD

BACKGROUND

This invention relates generally to liquid/lotion applicators that are designed for delivering lotions and liquids to hard-to-reach areas of the user's body, and more particularly to folding applicators of the type that fold to a compact shape wherein the folding action is adjustable to a plurality of predetermined angles.

It is frequently necessary for a person to apply lotions, liquids and other materials to areas of the body that are either out of reach or difficult to reach. Moreover, the problems associated with the application of such lotions are substantially increased for elderly and handicapped people who find it difficult to reach the lower extremities of the body.

Accordingly, a number of devices have been invented for applying lotions to a person's body. Some of the early designs, including U.S. Pat. No. 2,875,462 issued to Wittnebert and U.S. Pat. No. 3,124,828 issued to Barber, provide a suitable applicator head but lack an applicator handle of sufficient length to effectively reach hard-to-reach areas on a person's body including the lower legs and back area.

Later issued patents including U.S. Pat. No. 3,491,397 issued to Hessner, U.S. Pat. No. 3,568,237 issued to Rhodes, and U.S. Pat. No. 3,704,480 issued to Whitaker employ long handles to increase the length of reach. However, their designs do not allow the user to fold the same into a compact shape that is easy to manage and store.

Subsequently, U.S. Pat. No. 4,078,865 issued to Moser, and 4,171,171 issued to Jones included designs having means for continuously dispensing the lotion at the applicator head. Like the earlier designs, however, Moser and Jones lack the capacity to assume a compact shape yet provide a long reach.

Additionally, other various designs including U.S. Pat. No. 4,165,755 issued to Cassai that discloses a mascara wand; U.S. Pat. No. 4,299,005 issued to Brown disclosing a long (non folding) handle with tilting head; and U.S. Pat. No. 4,396,028 issued to Waggoner which discloses a telescopic handle. Like the patents noted above however, none of these designs include the features of folding to a compact size yet able to unfold to predetermined angles thereby extending to reach the extremities and difficult areas of the user's body.

SUMMARY

One object of the present invention is to deliver and apply lotion to hard-to-reach areas of the user's body.

A second object of the present invention is to enable the user to quickly and securely adjust the extent of range of reach of the applicator apparatus.

Another object is to reduce the amount of liquid that is wasted during the application thereof to hard-to-reach areas of the user's body.

Yet another object is to evenly apply liquid lotion to hard-to-reach areas of the user's body.

A further object of the present invention is to enable the user to quickly change the lotion applicator pads when a plurality of lotions are employed.

Still another object is to reduce the amount of liquid necessarily applied for a single complete application of the same.

The invention is a folding, hand-held lotion applicator for applying lotions to areas of a user's body that are difficult for the user to reach. The applicator includes an elongated applicator handle having a cross section sized to permit a comfortable grip by the hand of the user. At one end of the applicator is a linking end with a linking end bore disposed therethrough. The linking end bore is aligned to define a pivot axis that extends substantially transverse to the longitudinal axis of applicator handle.

Pivotally attached to the linking end of the applicator handle is an elongated pivot arm. The pivot arm includes an applicator end for applying lotion, and an opposing pivot end. The pivot end is formed to define a pivot end bore disposed therethrough and extending transverse to the longitudinal direction of the pivot arm. The pivot arm is pivotally received by the applicator handle so that the pivot end bore is aligned along the pivot axis. In this way, a pivot shaft can be employed along the pivot axis to pivotally connect the applicator handle to the pivot arm.

The pivot arm is pivotable from a folded position adjacent the applicator handle, to an unfolded position extending away from the applicator handle. In addition, the pivot arm is adjustable to a plurality of pre-determined pivot angles ranging between the folded position and the unfolded position.

A biasing member is provided to urge the pivot arm against the applicator handle to restrict relative movement therebetween. The biasing member is adjustable from an unbiased configuration where the pivot arm is free to rotate, to a biased configuration where the pivot arm is locked to maintain a pre-determined pivot angle. Moreover a receiving seat is formed in the applicator handle for receiving the pivot arm when the pivot arm is moved to the folded position.

In accordance with another aspect of the invention, the receiving seat defines a channel that includes opposing left and right sidewalls. With this configuration, the pivot arm can be received within the channel, between the opposing sidewalls when the pivot arm is moved to the folded position. Accordingly, the linking end bore extends through each opposing sidewall of the applicator handle, and the pivot end bore is coaxially disposed along the pivot axis between the opposing sidewalls.

In a further aspect of the invention, a pair of opposing detent surfaces are employed. Included therein is a linking end detent surface disposed about the linking end bore on one of said sidewalls of the channel, and a pivot end detent surface disposed about the pivot end bore of the pivot arm. The detent surfaces are configured to interengage at predetermined pivot angles to restrict relative rotational movement therebetween when the biasing member urges the pivot arm against the applicator handle.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 3 is across-sectional view of the preferred embodiment taken along line 3—3.

FIG. 4 is a fragmentary exploded view showing the applicator arm apart from the applicator handle.

DETAILED DESCRIPTION OF PREFERRED EMBODIMENT

Figure 1:
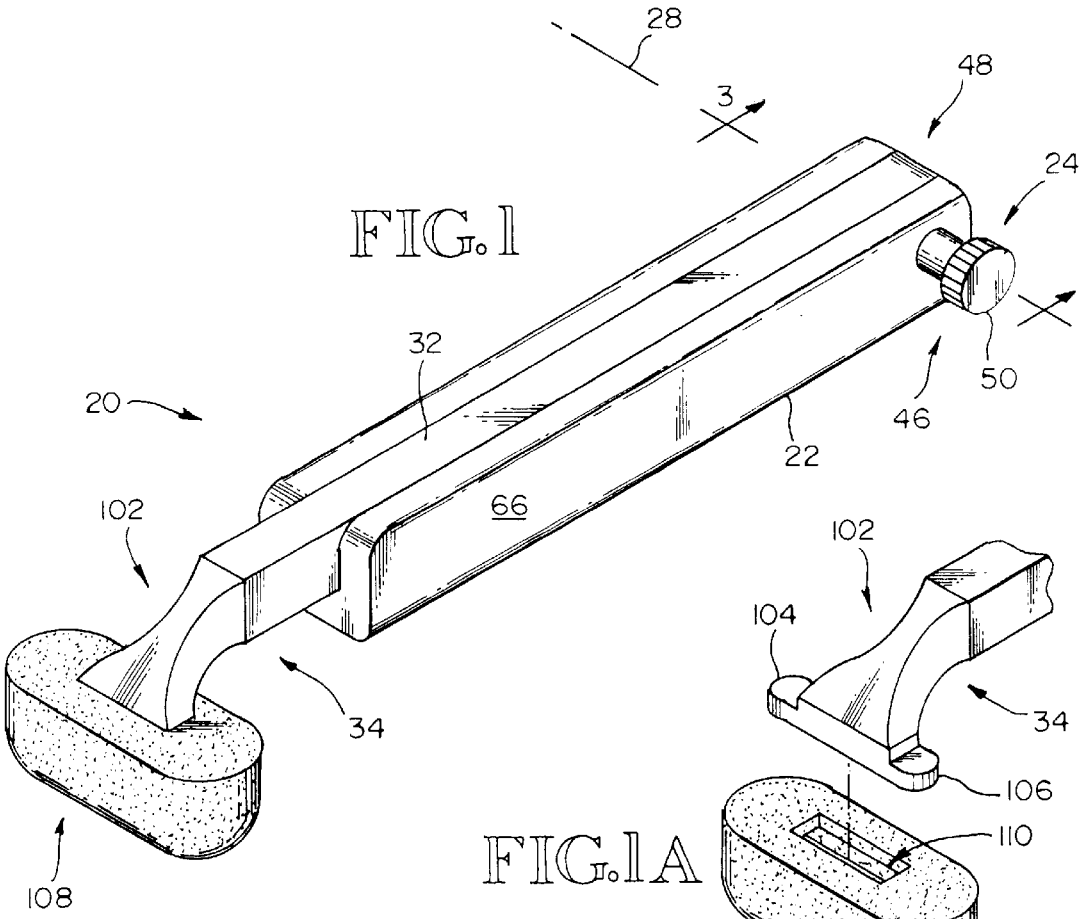
FIG. 1 is a frontal perspective view of a folded lotion applicator in accordance with the present invention.
Figure 2:
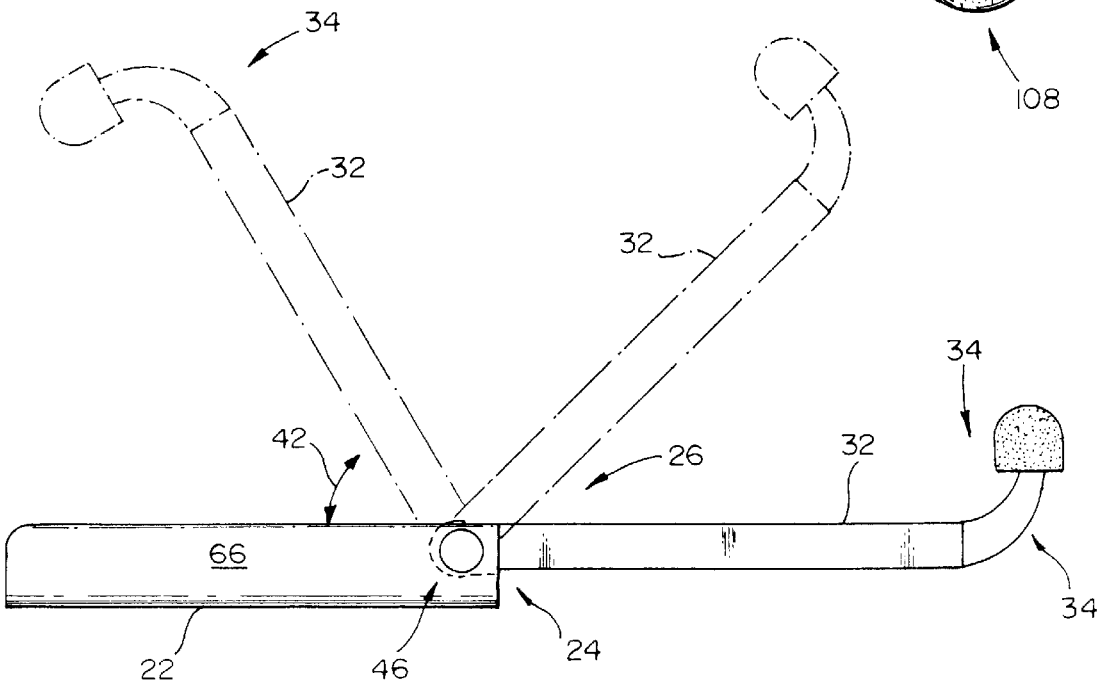
FIG. 2 is an elevational view of a lotion applicator illustrating movement of the applicator arm, the solid lines illustrating the fully extended applicator arm, and the broken lines illustrating the applicator arm in a partially folded position.
Figure 5:
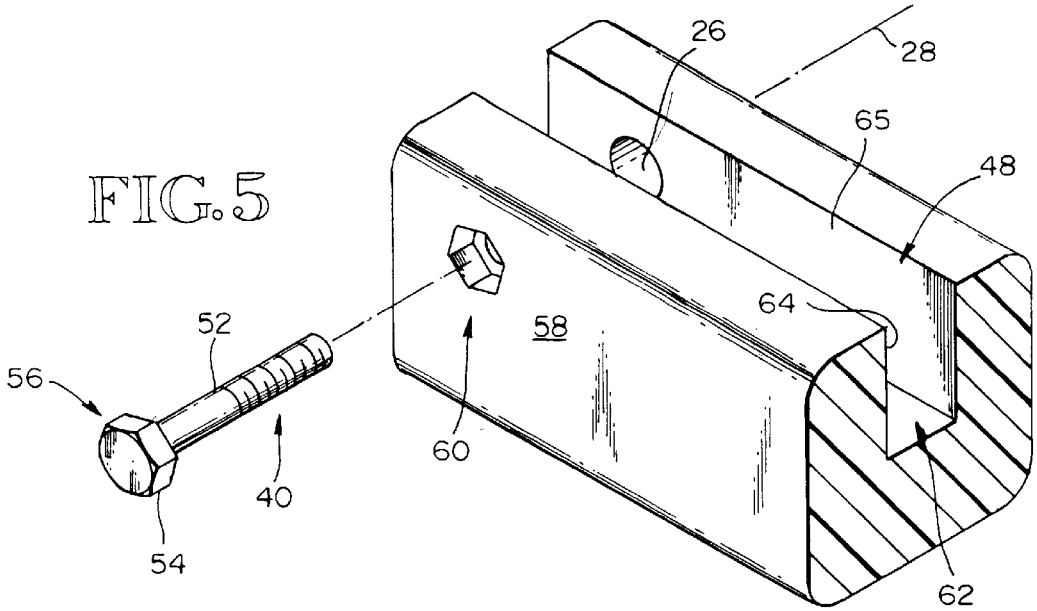
FIG. 5 is a partial perspective view of an applicator handle arranged with a counter bore shaped to precisely receive the head of a hex head bolt.

FIGS. 1 through 7 illustrate a lotion applicator 20 constructed in accordance with the present invention. As best seen in FIGS. 1 and 2, the lotion applicator 20 is of the type that folds from an unfolded, extended position, to a folded compact unit.

The lotion applicator 20 is provided for applying lotions (not illustrated) to areas of a user's body (not illustrated) that are difficult for the user to reach. The lotion applicator 20 comprises an elongated applicator handle 22 sized to permit a comfortable grip by the hand of the user. The applicator handle 22 includes, a linking end 24 with a linking end bore 26 disposed therethrough. The linking end bore 26 is aligned to define a pivot axis 28 that extends substantially transverse to the longitudinal direction of the applicator handle 22.

Pivotally connected to the applicator handle 22 is an elongated pivot arm 32. The pivot arm 32 comprises an applicator end 34 for applying lotion, and an opposing pivot end 36 The pivot end 26 is formed to define a pivot end bore 38 disposed therethrough and extending transverse to the longitudinal direction of the pivot arm 32. In the preferred embodiment, the pivot arm 32 is received by the applicator handle 22 so that the pivot end bore 38 is aligned along the pivot axis 28. In this way, a pivot shaft 40 can be positioned along the pivot axis 28 through the linking end bore 26 and through the pivot end bore 38 to pivotally connect the application handle 22 to the pivot arm 32.

With this arrangement, the pivot arm 32 is pivotable from a folded position adjacent the applicator handle 22 (FIG. 1), to an unfolded position extending away from the applicator handle 22 (FIG. 2). As seen in FIG. 2, the pivot arm 32 is adjustable to a plurality of pre-determined pivot angles 42.

To enable the user to maintain the pivot arm 32 at a desired pre-determined pivot angle 42 a biasing member 46 is disposed to urge said pivot arm 32 against the applicator handle 22 wherein said biasing member 46 is adjustable from an unbiased configuration where the pivot arm is free to rotate, to a biased configuration where the pivot arm 32 is locked to maintain the pivot angle 42. As illustrated in FIG. 1, a receiving seat 48 is formed by removing, i.e., shaping or forming a portion of the applicator handle 22 to receive the pivot arm 22 when the same is moved to the folded position.

Considering now in more detail the components from which a lotion applicator is constructed, FIGS. 3—4 illustrate the components that enable the pivotal connection of the pivot arm 32 to the applicator handle 22. It should be appreciated that in an assembled lotion applicator 20, the axis 39 of pivot end bore 38 is aligned along the pivot axis 28 which is defined by the linking end bore 26. Thus the pivot end bore 38 is coaxially disposed along the pivot axis 28. In the preferred embodiment, the biasing member 46 is a tightening nut 50 that threadedly engages the pivot shaft 40. For this connection, an ordinary threaded hex-head bolt 52 is employed as the pivot shaft 40. In this way the bolt head 54 acts as a restricting means 56 to prevent the pivot shaft 40 from sliding through the linking end bore 26 of the applicator handle 22.

In order to maintain a smooth exterior surface 58 of the applicator handle 22. The Bolt head 54 is received into a cavity 60 which extends slightly below the exterior surface 58, similar to a counterbore. However, in the preferred embodiment the cavity 60 is formed in the shape of a hexagon to closely fit the bolt head 54 so that the same is restricted from turning as the tightening nut 50 threadedly engages the hex head bolt 52. For this purpose, the tightening nut includes a threaded bore 57 as illustrated in FIG. 3 as a hidden line.

To enable the pivot arm 32 to be fully folded adjacent and within the applicator handle 22, the applicator handle 22 includes a receiving seat 48. In the preferred embodiment, the receiving seat 48 is defined by a channel 62. The channel 62 is formed by two opposing sidewalls: left sidewall 64 and right sidewall 65. In this way, the pivot arm 32 folds between the sidewalls 64–65, within the applicator handle 22 to a streamlined compact configuration as illustrated in FIG. 1. Accordingly, a tightening nut 50, that is outwardly disposed from the exterior surface 66, includes a bearing member 67 that extends through a sidewall, i.e., through a portion of the linking end bore 26. As illustrated in FIG. 3, one embodiment of the bearing member 67 is an extended portion 68 of the tightening nut 50. As will be seen below, the extended portion could comprise a separate bushing 69. It should be appreciated that the linking end bore 26 extends through each left and right sidewall 64–65 of the applicator handle 22.

In another embodiment, an ordinary bushing 69 is employed as the bearing member 67: the bushing 69 extends as a separate component from a three prong tightening nut 70 (FIG. 4). Accordingly, the bushing 69 is disposed between the three prong tightening nut 70 and the pivot arm 32. With this construction, the bushing 69 extends through a portion of the linking end bore 26, i.e., that portion of linking end bore 26 disposed through the right sidewall 65.

Like the tightening nut 50, the three prong tightening nut 70 includes a threaded bore 72 for threaded engagement with the hex head bolt 52. Thus, as the three prong tightening nut 70 engages the hex head bolt 52, it urges the bushing 69 against the pivot arm 32.

Figure 6:
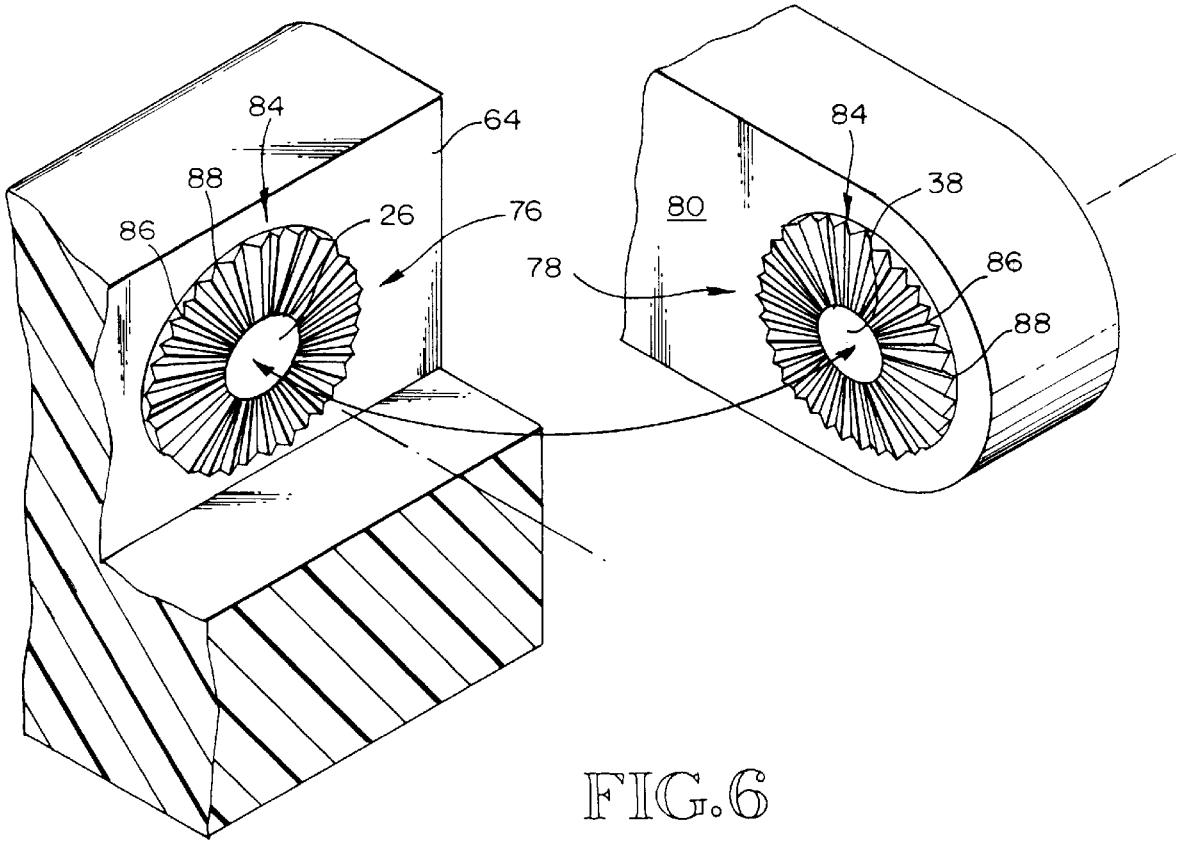
FIG. 6 is a partial fragmentary exploded view showing opposing detent surfaces having radially extending grooves disposed to interengage.

Turning now to FIGS. 4 and 6, opposing detent surfaces are illustrated including a linking end detent surface 76 and a pivot end detent surface 78. The opposing detent surfaces 76–78 are provided to prevent relative pivotal movement between the pivot arm 32 and the applicator handle 22. For this purpose, the linking end detent surface 76 is disposed about the linking end bore 26 on the left sidewall 64.

Similarly, the pivot end detent surface 78 is disposed about the pivot end bore 38 on the pivot arm face 80.

In the preferred embodiment, each detent surface 76–78 comprises a plurality of uniform, symmetrically spaced grooves 84 adjacently disposed to form alternate ridges 86 and valleys 88 that extend radially about the linking end bore 26, and about the pivot end bore 38. The detent surfaces are so formed to permit interengagement thereof when the pivot arm 32 is urged toward the applicator handle 22. As a result, relative pivotal movement is prevented. In this way, when the user sets the pivot angle 42 to the desired setting, the same is maintained as lotions are applied to the body.

Figure 7:
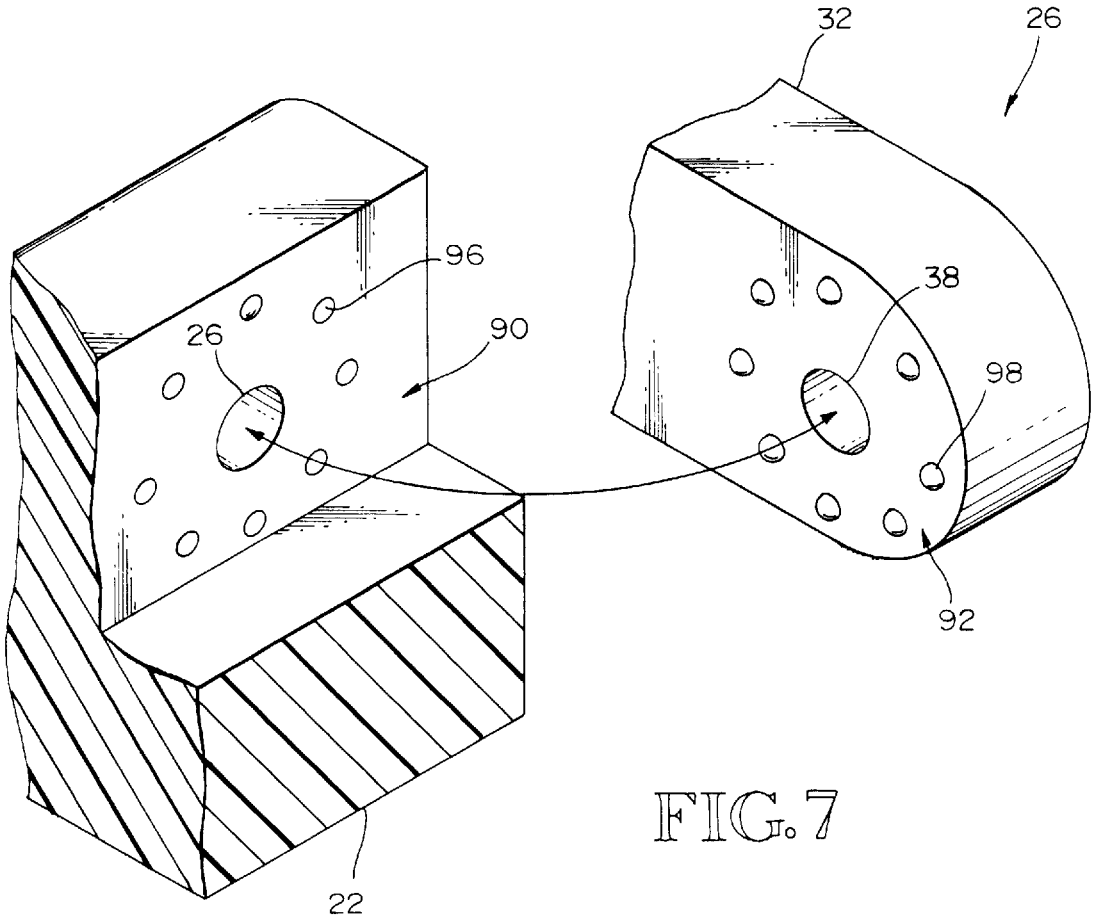
FIG. 7 is a partial fragmentary exploded view showing an alternate embodiment that includes opposing detent surfaces with one having a plurality of spaced male projections, the other having a plurality of female indentations respectively spaced for interengagement therebetween.

Alternately, as illustrated in FIG. 7, opposing detent surfaces include a linking end detent surface 90 comprising a plurality of spaced-apart like female indentations 96, and a pivot end detent surface 92 comprising a plurality of spaced-apart like male projections 98. For this embodiment, the male projections 98 are shaped and formed to be precisely received into the respective female indentations 96 when the linking end bore 26 is coaxially aligned with the pivot end bore 38 as the pivot arm 32 is pivotally connected to the applicator handle 22. Moreover, in contrast to the preferred embodiment, in this embodiment, the pivot end detent surface 92 is comprised solely of male projections 98, while the linking end detent surface 90 is comprised solely of female indentations 96.

It should be appreciated that the female indentations 96 and the male projections 98 are disposed respectively about the linking end bore 26 and about the pivot end bore 38 such that the same interengage when the pivot angle 42 is moved to pre-determined positions. In this way, relative rotational movement between the pivot arm 36 and the applicator handle 22 is restricted as the pivot arm 32 is urged against the applicator handle 22.

Figure 1A:
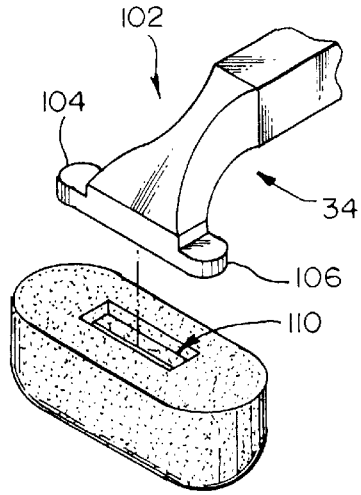
FIG. 1A is fragmentary exploded perspective view illustrating an applicator pad removed from the applicator pad receiving head.

Directing attention now to FIGS. 1 and 1A, an applicator end 34 is illustrated comprising an applicator head 102. The applicator head 102 is formed to include outwardly projecting arms 104 and 106. The applicator head 102 is so formed to permit attachment of an applicator pad 108 thereto. In the preferred embodiment, the applicator pad 108 is constructed of a sponge like material that can absorb and distribute liquids. Additionally, a portion of the applicator pad 108 is removed to form a slot 110. The slot 110 is sized so that the arms 104–106 can be placed therein to engage the same thereby securing the applicator pad 108 to the applicator head 102.

In operation, the lotion applicator 20 is manipulated by the user to apply lotion to areas of the body that are difficult for the user to reach. Typically the method of such use is intuitive and straight forward. Briefly, a lotion applicator 20 is assembled from a applicator handle 22 and a pivot arm 32, as noted above, so that the same are pivotally connected end-to-end. For receiving the lotion, a fresh applicator pad 108 is installed over the applicator head 102, such that the slot 110 within the applicator pad 108 engages the arms 104–106. After the lotion is applied to the applicator pad 108, the pivot arm 32 is pivoted to the desired pivot angle 42 and locked into position by turning the tightening nut which in turn urges the pivot arm 32 toward the applicator handle 22. Specifically, the opposing detent surfaces 76–78 interengage and prevent relative pivotal movement.

When the user is finished with the lotion applicator 20, the tightening nut 50 is loosened to allow the pivot arm 32 to be pivoted adjacent the applicator handle 22, within a channel 62. As earlier noted, the channel 62 is formed by specially shaped, i.e., removed portions of the applicator handle 22. In this way, the lotion applicator 20 assumes a compact shape. Finally, it should be understood that the lotion applicator 20, and the parts thereof, could be constructed from any conventional material including plastics, metal, wood or a combination thereof.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed:

1. A folding, hand-held lotion applicator for applying lotions to areas of a user's body that are difficult for the user to reach, the lotion applicator comprising:

an elongated applicator handle sized to permit a comfortable grip by the hand of the user, the applicator handle having a linking end with a linking end bore disposed therethrough, the linking end bore being aligned to define a pivot axis that extends substantially transverse to the longitudinal direction of applicator handle;

an elongated pivot arm comprising an applicator end for applying lotion, and an opposing pivot end, the pivot end defining a pivot end bore disposed therethrough extending transverse to the longitudinal direction of the pivot arm, the pivot arm being received by the applicator handle so that the pivot end bore is aligned along the pivot axis;

a pivot shaft disposed along the pivot axis pivotally connecting the applicator handle to the pivot arm;

the pivot arm being pivotable from a folded position adjacent the applicator handle, to an unfolded position extending away from the applicator handle, the pivot arm being adjustable to a plurality of pre-determined pivot angles;

a biasing member disposed to urge said pivot arm against the applicator handle wherein said biasing member is adjustable from an unbiased configuration where the pivot arm is free to rotate, to a biased configuration where the pivot arm is locked to maintain a pre-determined pivot angle;

a receiving seat defined by a portion of the applicator handle to receive the pivot arm when the pivot arm is moved to the folded position;

wherein the receiving seat defines a channel having opposing left and right sidewalls, the pivot arm being received within the channel, between the opposing sidewalls when the pivot arm is moved to the folded position, wherein the linking end bore extends through each opposing sidewall of the applicator handle, and wherein the pivot end bore is coaxially disposed along the pivot axis therebetween; and wherein the biasing member comprises a tightening nut that threadedly engages the pivot shaft, the pivot shaft having restricting means for impeding the pivot shaft from sliding through said linking end bore as the tightening nut threadedly engages the pivot shaft, and a bearing member that extends from the tightening nut through a portion of the linking end bore, to the pivot arm, wherein as the tightening nut is tightened, the bearing member engages the pivot arm and urges the same against one of said left and right sidewalls.

2. A lotion applicator as recited in claim 1 wherein the bearing member is defined by an extended portion of the tightening nut.

3. A lotion applicator as recited in claim 2 wherein the bearing member includes a threaded bore for threaded engagement with the pivot shaft.

4. A method of applying lotion to areas of a user's body that are difficult for the user to reach, the method comprising the steps of:

providing an elongated applicator handle having a cross-section of a size to permit a comfortable grip by the hand of the user, the applicator handle having a linking end with a linking end bore disposed therethrough, the linking end bore defining a pivot axis aligned substantially transverse to the longitudinal direction of applicator handle;

pivotally connecting an elongated pivot arm to the linking end of said applicator handle, the pivot arm having an applicator end and an opposing pivot end, the pivot end defining a pivot end bore disposed therethrough, the pivot arm being pivotally connected to the linking end of said applicator handle wherein the pivot end bore is coaxially aligned with the pivot axis, the pivot arm being pivotable from a folded position adjacent the applicator handle, to an unfolded position extending away from the applicator handle, the pivot arm being adjustable to a plurality of pre-determined pivot angles;

adjusting the pivot arm to a pre-determined pivot angle;

biasing said pivot arm against the applicator handle wherein said pivot arm is locked to maintain a pre-determined pivot angle so that the user can apply lotion to the applicator end of the pivot arm for distribution to various areas of the user's body; and removing a portion of the applicator handle to define a channel for receiving the pivot arm when the pivot arm is moved to the folded position;

wherein the step of biasing said pivot arm includes the step of providing a pivot shaft disposed through the locking end bore and through the pivot end bore to threadedly engage a tightening nut, wherein a bearing member extends from the tightening nut through a portion of the linking end bore, to the pivot arm wherein as the tightening nut is tightened, the bearing member engages the pivot arm and urges the same against a sidewall of the channel; and applying lotion to the applicator end of the pivot arm; and distributing the lotion to various areas of the user's body.

5. A method of applying lotion as recited in claim 4 wherein the step of biasing said pivot arm includes providing a pair of opposing detent surfaces including a linking end detent surface disposed about the pivot axis on the sidewall of the channel, and a pivot end detent surface disposed about the pivot end bore of the locking end, the detent surfaces configured to mesh at pre-determined pivot angles to restrict relative rotational movement therebetween when the biasing member biases the pivot arm against the applicator handle.

6. A method of applying lotion as recited in claim 5 wherein the detent surfaces comprise a plurality of radially extending grooves.

* * * * *